US009038245B2

(12) United States Patent
Owens et al.

(10) Patent No.: US 9,038,245 B2
(45) Date of Patent: May 26, 2015

(54) FATIGUE REDUCTION DEVICE

(71) Applicants: Brian D. Owens, Plano, TX (US); Christie L. Owens, Plano, TX (US); Paul W. Lester, Hurricane, UT (US); Kellie Baker, Prosper, TX (US); Clark Davis, Provo, UT (US)

(72) Inventors: Brian D. Owens, Plano, TX (US); Christie L. Owens, Plano, TX (US); Paul W. Lester, Hurricane, UT (US); Kellie Baker, Prosper, TX (US); Clark Davis, Provo, UT (US)

( * ) Notice: Subject to any disclaimer, the term of this patent is extended or adjusted under 35 U.S.C. 154(b) by 0 days.

(21) Appl. No.: 13/841,214

(22) Filed: Mar. 15, 2013

(65) Prior Publication Data

US 2014/0259535 A1 Sep. 18, 2014

(51) Int. Cl.
*B25G 1/10* (2006.01)
*A45F 5/10* (2006.01)

(52) U.S. Cl.
CPC ..... *A45F 5/10* (2013.01)

(58) Field of Classification Search
CPC ..... A45F 5/10
USPC ..... 16/430, 431, 110.1, 111.1; 224/267
See application file for complete search history.

(56) References Cited

U.S. PATENT DOCUMENTS

| | | | | |
|---|---|---|---|---|
| 5,531,668 | A * | 7/1996 | Mann et al. | 602/13 |
| 5,658,044 | A * | 8/1997 | Krevh | 297/183.6 |
| 6,626,489 | B2 | 9/2003 | Geis et al. | |
| 6,913,313 | B2 * | 7/2005 | Sedlack | 297/183.4 |
| 6,926,181 | B1 | 8/2005 | Vath | |
| 7,325,871 | B2 | 2/2008 | Gangadharan et al. | |
| 8,033,599 | B2 | 10/2011 | Meeker et al. | |
| 2003/0164627 | A1 * | 9/2003 | Sedlack | 297/183.1 |
| 2012/0175920 | A1 * | 7/2012 | Carbone | 297/183.1 |

* cited by examiner

*Primary Examiner* — Victor Batson
*Assistant Examiner* — Matthew Sullivan
(74) *Attorney, Agent, or Firm* — McKee, Voorhees & Sease, P.L.C.

(57) ABSTRACT

The fatigue reduction device includes a frame configured to receive a handle substantially perpendicularly to a longitudinal axis of the frame. A user-faceable portion of the frame is inwardly concave to conform to an arm of a user.

18 Claims, 16 Drawing Sheets

FATIGUE REDUCTION DEVICE

RELATED APPLICATIONS

This application claims priority to U.S. provisional patent application Ser. No. 61/691,995 entitled "Fatigue Reduction Device" filed Aug. 22, 2012 the entire contents of which are all hereby incorporated by reference in their entirety.

BACKGROUND OF THE INVENTION

The number of bags, carriers, containers, and objects carried by people is extensive. In many cases, the objects or carriers do not include the most comfortable handles or straps. For example, the handle or straps may become uncomfortable during extended use. In some cases, individuals may resort to carrying their bag or carrier utilizing different parts of their arm to reduce hand fatigue. Unfortunately, over time this method of carrying objects or carriers becomes uncomfortable due to the existing shape, design, and required orientation.

SUMMARY OF THE INVENTION

One embodiment includes a fatigue reduction device. The fatigue reduction device may include a frame configured to receive a handle substantially perpendicularly to a longitudinal axis of the frame. A user-faceable portion of the frame may be inwardly concave to conform to an arm of a user.

The fatigue reduction device may include a frame configured to receive a handle substantially perpendicularly to a longitudinal axis of the frame. The fatigue reduction device may include at least three user-faceable surfaces of the frame that are inwardly concave to conform to an arm of a user.

Another embodiment includes a carrying device. The carrying device may include a member inwardly concave to conform to an arm of a user. The member may define a number of extensions for securing a handle substantially perpendicular to a longitudinal axis of the member.

Other embodiments provide a method of manufacturing and utilizing a fatigue reduction device.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

Figure 1:
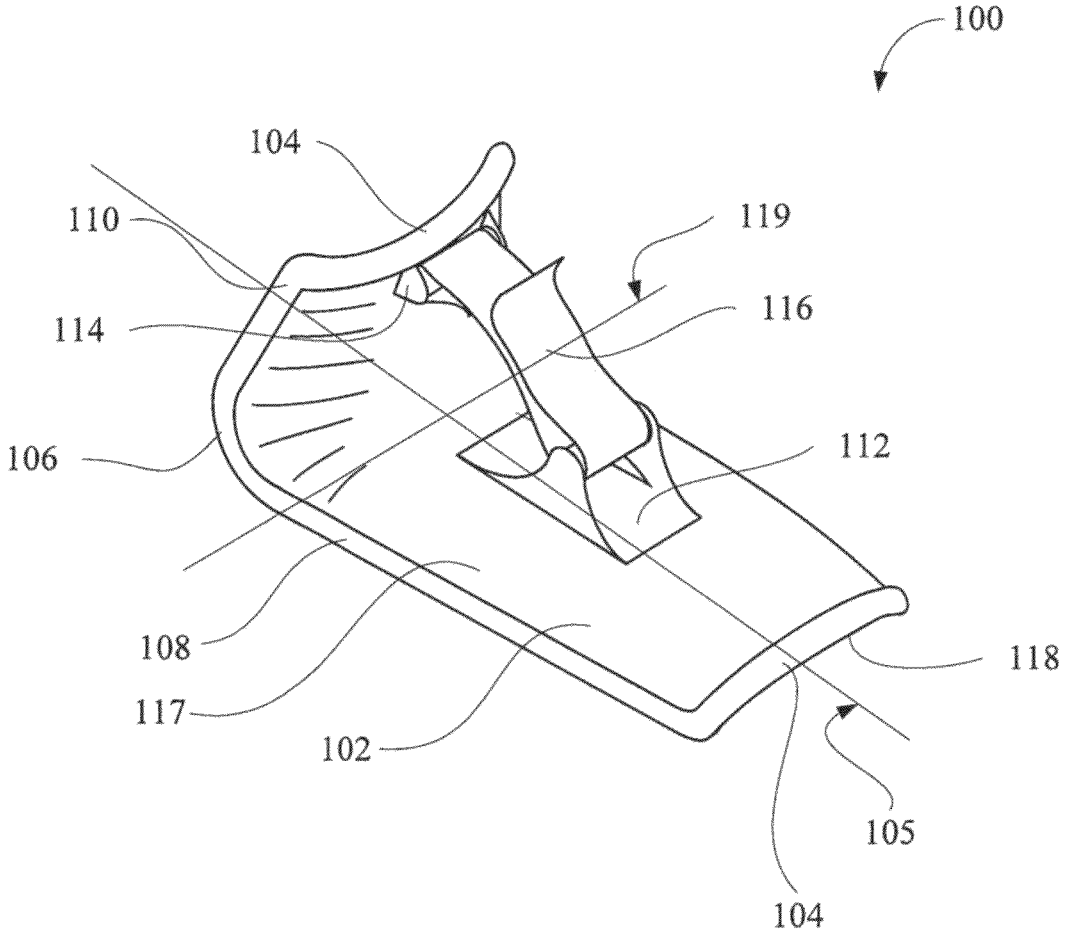
FIG. 1 is a pictorial representation of a fatigue reduction device in accordance with an illustrative embodiment.

Illustrative embodiments provide various fatigue reduction devices and methods of manufacture and utilization. The fatigue reduction device may be a stand-alone device or may be integrated with other devices, such as infant carriers, bags, coolers, luggage, or so forth. As used herein, infant carriers, bags, coolers, luggage, equipment, or other carried objects that may or may not include handles, straps, or other carrying mechanisms may be referred to herein as carriers or objects. The fatigue reduction device may also be referred to as a forearm carrier, an elbow carrier, a carrying assistant, or so forth. The fatigue reduction device may secure carriers of any size, shape, or configuration to reduce fatigue, decrease comfort, and increase convenience for a user holding, supporting, or carrying the carrier utilizing the fatigue reduction device.

The fatigue reduction device may be configured to secure or receive straps or handles of the carrier referred to herein as a handle or object. Extensions from the frame of the fatigue reduction device may be utilized to secure the object when utilized horizontally, vertically, or at an angle. The handle or straps may be actively received by the fatigue reduction device (e.g. between the frame and extensions) utilizing a clip, clamp, Velcro straps, slide-in attachment, or other attachment mechanisms. In another embodiment, the fatigue reduction device may passively secure the handle or straps during utilization based on gravity and applied pressure. The fatigue reduction device may include extensions for keeping the straps or handle in place during utilization. For example, fully or partially surrounding extensions in the form of in the form of protrusions, grips, semi-circles, or circular extensions may secure the straps or handle.

A portion of the exterior of the fatigue reduction device or user-faceable portion in contact with the arm of a user may be curved to conform to the shape of an arm of the user. For example, a user contact side of the fatigue reduction device may be concavely shaped to ergonomically fit a portion of the forearm, elbow (crook), and bicep of the user. The curved shape of the exterior of the fatigue reduction device provides additional stability while in use. The exterior or curved portion of the fatigue reduction device that comes in contact with the body of the user may be padded to provide additional comfort to the user as the carrier is carried. In one embodiment, the fatigue reduction device is formed of high-strength plastics with co-molded, integrated, or externally attached padding or cover, such as foam, rubber, or neoprene providing additional padding. In another embodiment, the fatigue reduction device may be composed of thermoplastic, thermosetting plastic materials, wood, metal, polymers, etc. In a further embodiment, the fatigue reduction device may include straps to wrap around the arm of the user to provide additional stabilization and support, and to further assist in preventing the fatigue reduction device from slipping off the arm of the user during use. The straps may be connected by any temporary fastening device, such as Velcro, snaps, clasps, buttons, or magnets that may provide quick and easy attachment and removal of the device by the user. The exterior or curved portion of the fatigue reduction device that comes in contact with the body of the user may also be lined with a semi-sticky material or Velcro that may temporarily stick to and/or grip the clothing of a user during use, to further assist in preventing the fatigue reduction device from slipping off the arm of the user during use.

The fatigue reduction device may have any number of shapes including a reverse seven shape, a flattened u-shaped with widening legs (substantially trapezoidal), a flat shape, a padded sleeve shape, oval shape or a substantially triangular shape. However, the fatigue reduction device may utilize any number of shapes and configurations. The fatigue reduction device may be rested on a forearm of the user, tucked into the crook of the user's arm, fitted around the arm of a user, grasped utilizing a handle, or attached to another device, component, or body part. For example, one or more ends, vertices, or other portions of the fatigue reduction device may include a handle for holding the fatigue reduction device and moving the carrier. As a result, the fatigue reduction device may be carried in various positions depending on the preferences of the user.

The fatigue reduction device may also include a curved or hooked end for attaching or hanging the fatigue reduction device from luggage, a bag, a shoulder, a table, a door, an arm, or other device or component. The fatigue reduction device may also be configured to receive or be fitted with a cover or sleeve for adding additional padding, absorbing sweat and dirt, or for aesthetics. A sleeve may partially or entirely cover the fatigue reduction device. For example, the fatigue reduction device may be used with an infant carrier, and as such, some users may want the fatigue reduction device to match the look, material, design, or upholstery of the infant carrier.

FIG. 1 is a pictorial representation of a fatigue reduction device 100 in accordance with an illustrative embodiment. In one embodiment, the fatigue reduction device 100 may have a reverse seven or L-shape. The fatigue reduction device 100 may include a frame 102. The frame 102 is the main body of the fatigue reduction device 100. In one embodiment, the frame 102 is molded from a single piece of material, such as plastic.

The frame 102 may include an inward, or concave, curve 104. The inward curve 104 is shaped to conform to the forearm, elbow, and bicep of the user. In addition, the entire frame 102 may be inwardly concave (away from the exterior surface) to provide additional support, rigidity, and comfort. The depth of the inward curve 104 may vary between a slight curve and a much deeper curve. The inward curve 104 may extend along the exterior length of the frame 102. For example, the inward curve 104 may be arced (inwardly concave) and extend along a longitudinal axis 105 of the fatigue reduction device 100. In another embodiment, the inward curve 104 may be trapezoidal or triangular groove that may or may not be rounded. The frame 102 is the body of the fatigue reduction device 100 that supports and distributes the weight of the object being carried across portions of the user's arm.

The frame 102 further defines a corner 106. The corner 106 separates a first portion 108 of the frame 102 from a second portion 110. In one embodiment, the first portion 108 may be positioned against the arm (or forearm) of the user, the corner 106 may be positioned against the crook of the user's arm, and the second portion 110 may be positioned against the bicep or upper arm of the user. However, the fatigue reduction device 100 may be utilized or positioned in any number of traditional or untraditional ways, positions, orientations, or configurations that are selected or desirable to the user.

The frame 102 may include extensions 112 and 114. In one embodiment, the extensions 112 and 114 are an integrated portion of the frame 102 that actively or passively secure the handle or object of a carrier. In another embodiment, the extensions 112 and 114 may be separately connected or positioned. For example, the extensions 112 and 114 may be attached at any number of positions, slip to different positions, or replaced with alternatively shaped extensions. The extensions 112 and 114 may be anchor or connection points for a connector, such as a Velcro strap 116. The extensions 112 and 114 may define slits or openings for receiving the Velcro strap 116. The Velcro strap 116 may alternatively be replaced by a band, rope, carabiner, hinged gate, latch, or other connection component.

The extensions 112 and 114 may be configured to define a movement range for a handle of the carrier. For example, the handle or object may be positioned substantially perpendicular to the longitudinal axis 105 along a lateral axis 119 of the fatigue reduction device 100. In one embodiment, the extensions 112 and 114 may allow the handle to rotate slightly for optimal positioning. In another embodiment, the extensions 112 and 114 may closely abut the handle providing firmness and stability.

The fatigue reduction device 100 may include an interior surface 117 and an exterior surface 118. In one embodiment, the interior surface 117 of the frame 102 may be formed of polypropylene. The exterior surface 118 may be formed of a softer material such as foam, rubber, or a softer plastic. In one embodiment, the frame 102 may be molded with the exterior surface 118 being subsequently co-molded to provide a softer surface. Varying portions of the fatigue reduction device 100, such as a handle or space between the extensions 112 and 114, may be coated with an anti-slip material or pattern for stabilization.

Figure 2:
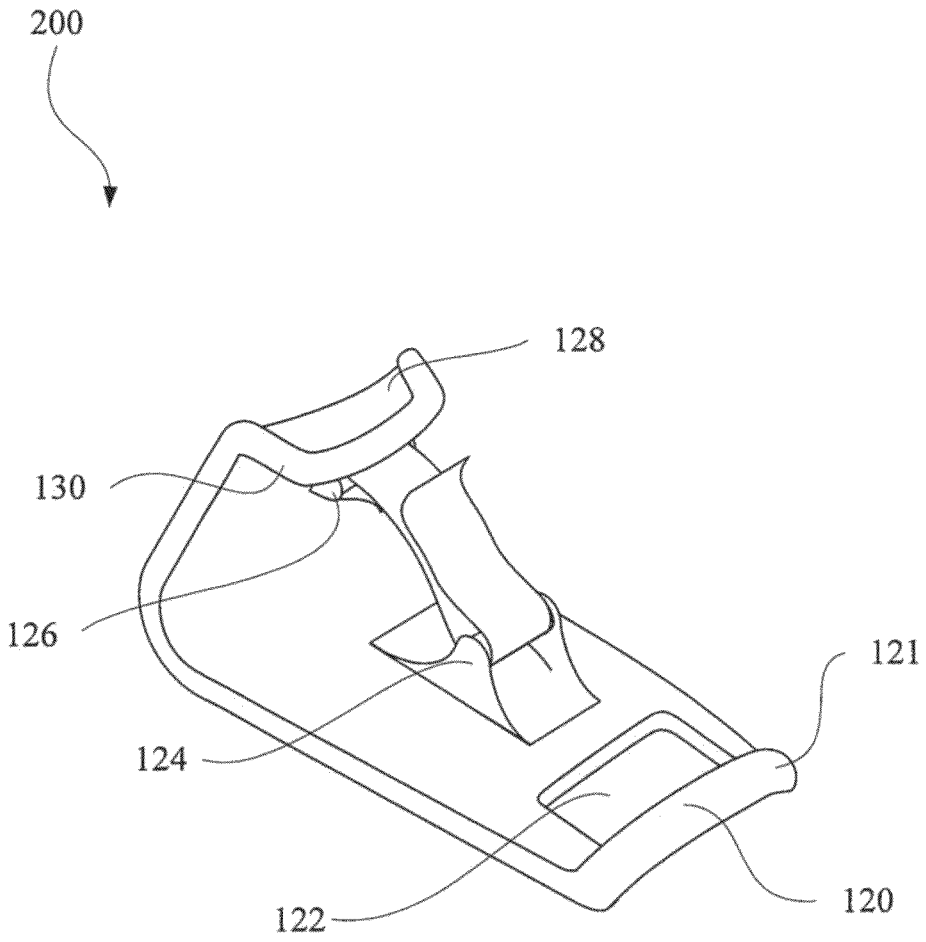
FIG. 2 is a pictorial representation of a fatigue reduction device in accordance with an illustrative embodiment.

FIG. 2 is a pictorial representation of a fatigue reduction device 200 in accordance with an illustrative embodiment. The fatigue reduction device 200 may include many of the components and features of the fatigue reduction device 100 of FIG. 1.

As previously described, the fatigue reduction device 200 may also be utilized by a user grasping a handle 120 (instead of being positioned on the forearm of crook of the user's arm). In one embodiment, the fatigue reduction device 200 may include the handle 120 defined at a first end 121 of the frame 102. The handle 120 may be cylindrically shaped. In another embodiment, the handle 120 may be ergonomically shaped to fit the hand and fingers of the user. For example, the handle 120 may include grooves, finger separators, spindle shape, narrowing and expanding diameters, and so forth. The handle 120 may be particularly useful for carrying bags or other carrying devices with uncomfortable or awkward straps or handles. The handle 120 may also allow the fatigue reduction device 200 to be utilized at a different angle and configuration.

In another embodiment, the handle 120 may be T-shaped (not shown) including a base that extends from the frame 102 and a handle connected to or integrated with the base. The T-shaped handle or portion of the fatigue reduction device 200 may be configured to be secured by the hand of the user with the base being positioned between fingers of the user (e.g. between the middle finger and ring finger) during utilization. The T-shaped handle may similarly have the inward curve 104 for similarly conforming to the shape of the user's arm.

The frame 102 may further define a space 122. The space 122 is an opening or cavity for receiving all or a portion of the user's hands or fingers. In one embodiment, the portion of the frame 102 on either side of the space 122 may be thicker that the rest of the frame to support the weight placed on the fatigue reduction device 200 when the user is utilizing the handle 120.

The frame 102 may further curve at a second end 128 to form a hook 130. The hook 130 and second portion 110 may take any number of shapes depending on the application (e.g. similar to hanger shapes, fish hooks, etc). The hook 130 may curve substantially perpendicular to the second portion 110. In another embodiment, the hook 130 may curve at an oblique or acute angle to the second portion 110. The hook 130 may be utilized to hook, set, or connect the fatigue reduction device 200 on a piece of luggage, seat, holder, table, door, or other component. The tip of the hook 130 may further curve for facilitating connection to another device or component. For example, the fatigue reduction device 200 may be utilized to first carry a duffle bag utilizing an arm of the user as well as subsequently connecting the duffle bag resting on the extension 124 to a roller bag utilizing the hook 130. The fatigue reduction device 200 may be useful for individuals carrying oversized duffle bags with work, sports, hunting, or camping equipment. In one embodiment, the fatigue reduction device 200 may be used while hunting. While hunting, a shotgun or rifle barrel is often rested inside the crook or elbow of a hunter's arm when not being fired. The fatigue reduction device 200 of the present invention may be modified to be used while hunting by removing strap 116 and extension 126, and further modifying extension 124 to support the barrel of a shotgun or rifle. The fatigue reduction device may also be camouflaged in coloration. In another embodiment, the second portion 110 may be elongated for facilitating connection to a luggage handle. The distance separating the extension 126 from the hook 130 may vary based on application. For example, a greater separation distance may facilitate more easily connecting the hook 130. In addition, the curvature of the tip of the hook 130 may vary from a slight curve to nearly curving all the way back on itself. The hook 130 may also be utilized to store the fatigue reduction device 200 (and attached component) when not in use.

Extensions 124 and 126 of the fatigue reduction device 200 are positioned distinctly for receiving and supporting the handle of a carrier. In one embodiment, one or more of the extensions 124 and 126 may be inwardly curved toward the second portion 110 for supporting the carrier when the handle 120 is positioned at the bottom. The extension 124 may support the handle of the carrier when the hook 130 is being utilized or when vertically positioned with the handle 120 at the bottom and the hook 130 at the top. The depth of the curvature of the extension 124 may vary for stabilizing the handle against the extension 124.

Figure 3:
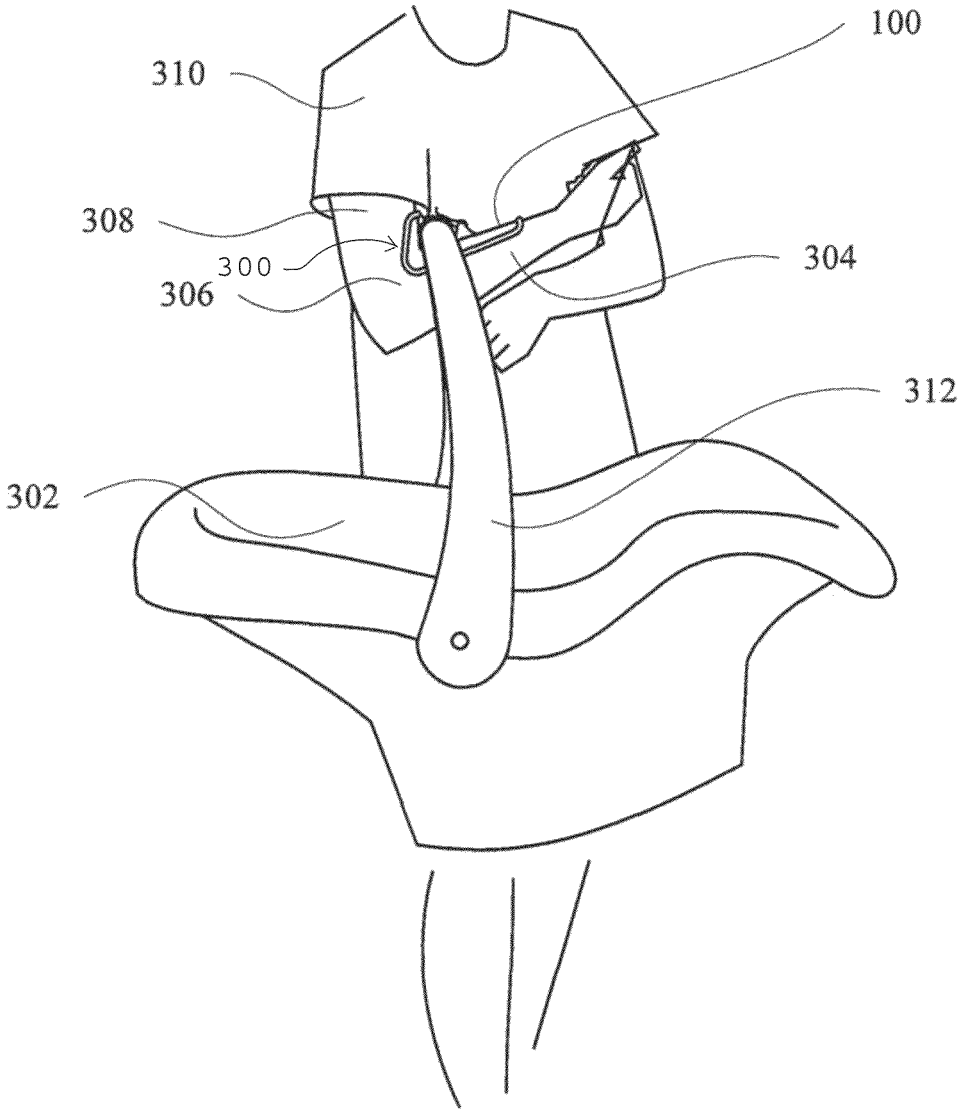
FIG. 3 is a pictorial representation of a fatigue reduction device being utilized with an infant carrier in accordance with an illustrative embodiment.

FIG. 3 is a pictorial representation of a fatigue reduction device 300 being utilized with an infant carrier 302 in accordance with an illustrative embodiment. As shown, the fatigue reduction device 300 may be carried on the forearm 304, crook 306, and a bicep 308 of a user 310. The fatigue reduction device 300 may further distribute the weight associated with the fatigue reduction device 300.

The fatigue reduction device 300 may be particularly useful when carrying the infant carrier 302 over longer distances. The fatigue reduction device 300 may also be useful for petite users, the elderly, or those with less strength and endurance. The fatigue reduction device 300 may connect to a handle 312 of the fatigue reduction device 300.

Figure 4:
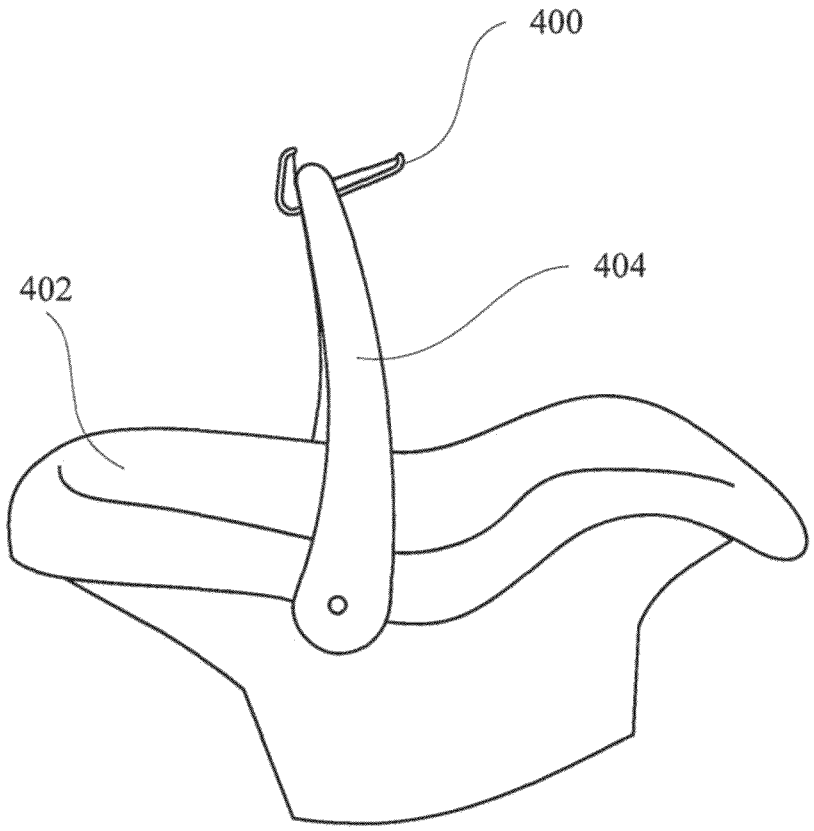
FIG. 4 is a pictorial representation of a fatigue reduction device integrated with an infant carrier in accordance with an illustrative embodiment.

FIG. 4 is a pictorial representation of a fatigue reduction device 400 integrated with an infant carrier 402 in accordance with an illustrative embodiment. In one embodiment, the fatigue reduction device 400 may be fixable or slidably integrated with the infant carrier 402. For example, a handle 404 may be substantially semi-circular or U-shaped. The fatigue reduction device 400 may be slidably attached to the handle 404 to move to either of the corners or vertices of the U. For example, the fatigue reduction device 400 may be slid to a bottom portion of the handle 404 for storage. The infant carrier 402 or the handle 404 may even include a receptacle for externally or internally receiving or storing the fatigue reduction device 400.

Figure 5:
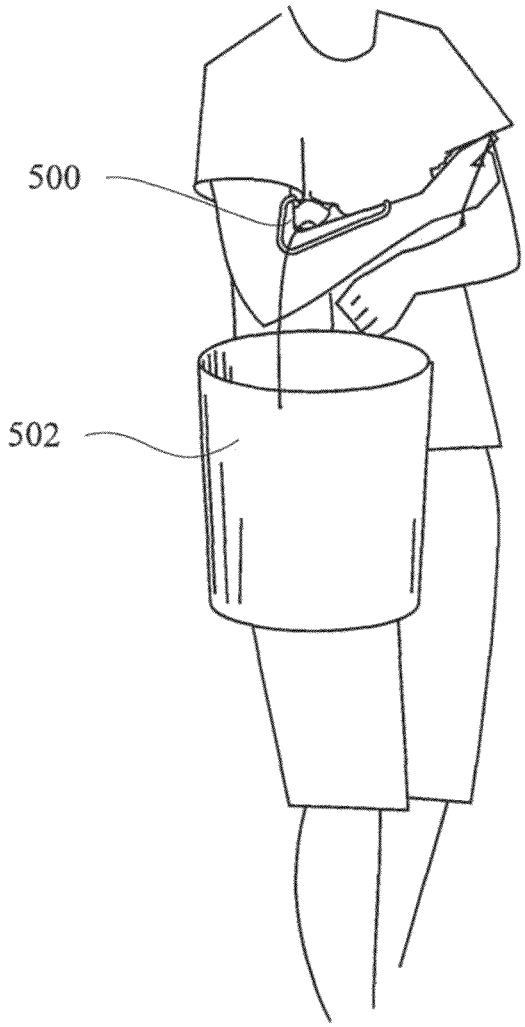
FIG. 5 is a pictorial representation of a fatigue reduction device being utilized with a bucket in accordance with an illustrative embodiment.

FIG. 5 is a pictorial representation of a fatigue reduction device 500 being utilized with a bucket 502 in accordance with an illustrative embodiment. The fatigue reduction device 500 may be utilized with any number of carriers as is herein described. The fatigue reduction device 500 may facilitate the user in moving an object, such as the bucket 502 from one point to another.

Figure 6:
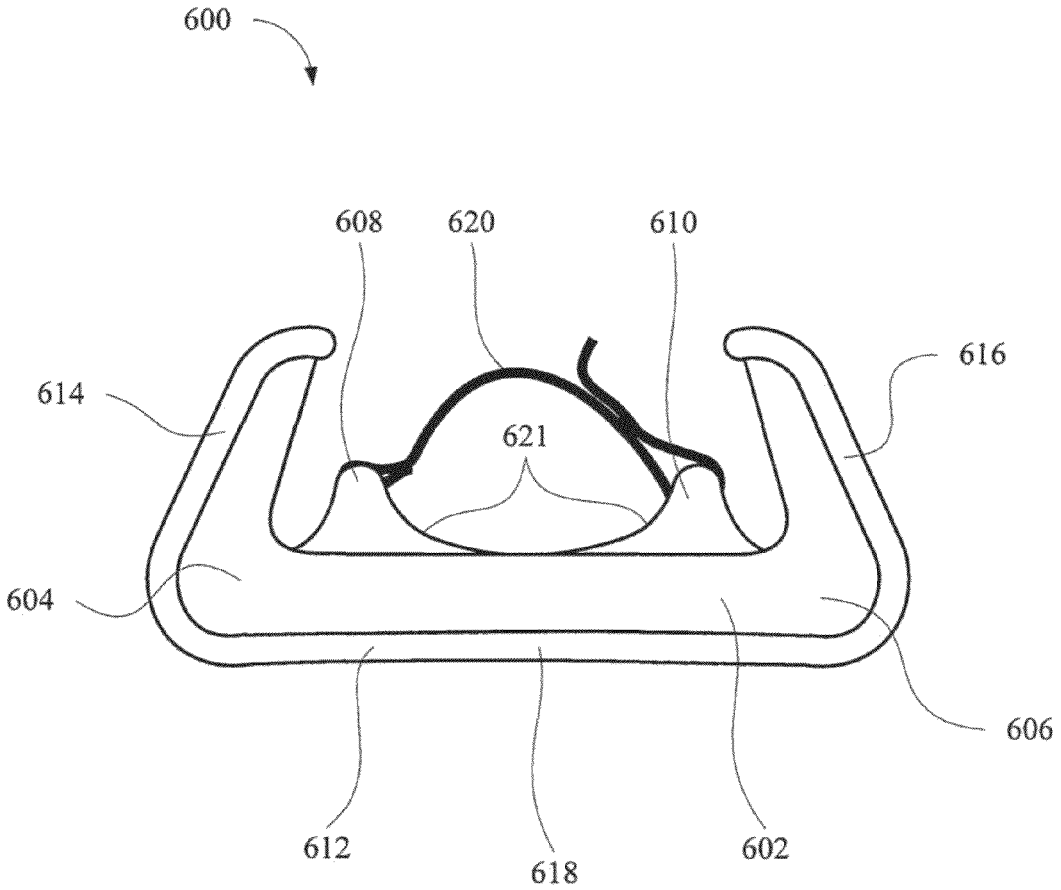
FIG. 6 is a side-view of another fatigue reduction device in accordance with an illustrative embodiment.

FIG. 6 is a side-view of another fatigue reduction device 600 in accordance with an illustrative embodiment. The fatigue reduction device 600 may be similar to the previous embodiments and include a frame 602, corners 604 and 606, extensions 608 and 610, a bottom face 612, side faces 614 and 616, an exterior portion 618, and a Velcro strap 620.

The fatigue reduction device 600 may be more easily used for carrying an object using a left or right arm or from either direction or user orientation. The extensions 608 and 610 may be utilized to stabilize the object while being carried. In another embodiment, the extensions 608 and 610 may fully or partially encompass the handle of the carrier. For example, the extensions 608 and 610 may further encompass the handle of the carrier by creating a semi-circular shape extending from the frame 602. In this example, the extensions 608 and 610 may be pried or forced open to accept the object. In another embodiment, the Velcro strap 620 may be replaced by a latch or buckle for enclosing the object between the extensions 608 and 610. The extensions 608 and 610 may be curved or straight. In one embodiment, the extensions 608 and 610 include a curved structure 621 for naturally guiding the handle to a middle point of the frame 602 between the extensions 608 and 610.

In one embodiment, each end or tip of the side faces 614 and 616 may include a hook as previously described for hanging or supporting the fatigue reduction device 600. As shown, the angle between the bottom face 612 and side faces 614 and 616 may vary. A more acute angle may facilitate squeezing the fatigue reduction device 600 between the forearm and bicep of the user. A more perpendicular angle may be utilized for applications where the fatigue reduction device 600 rests mainly on the forearm. In another embodiment, the angle between the bottom face 612 and the side faces 614 and 616 may be adjustable. For example, the corners 604 and 606 may be formed of an accordion-like or pivot joint structure that allows for adjustment or all or portions of the fatigue reduction device 600 may be flexible.

Figure 7:
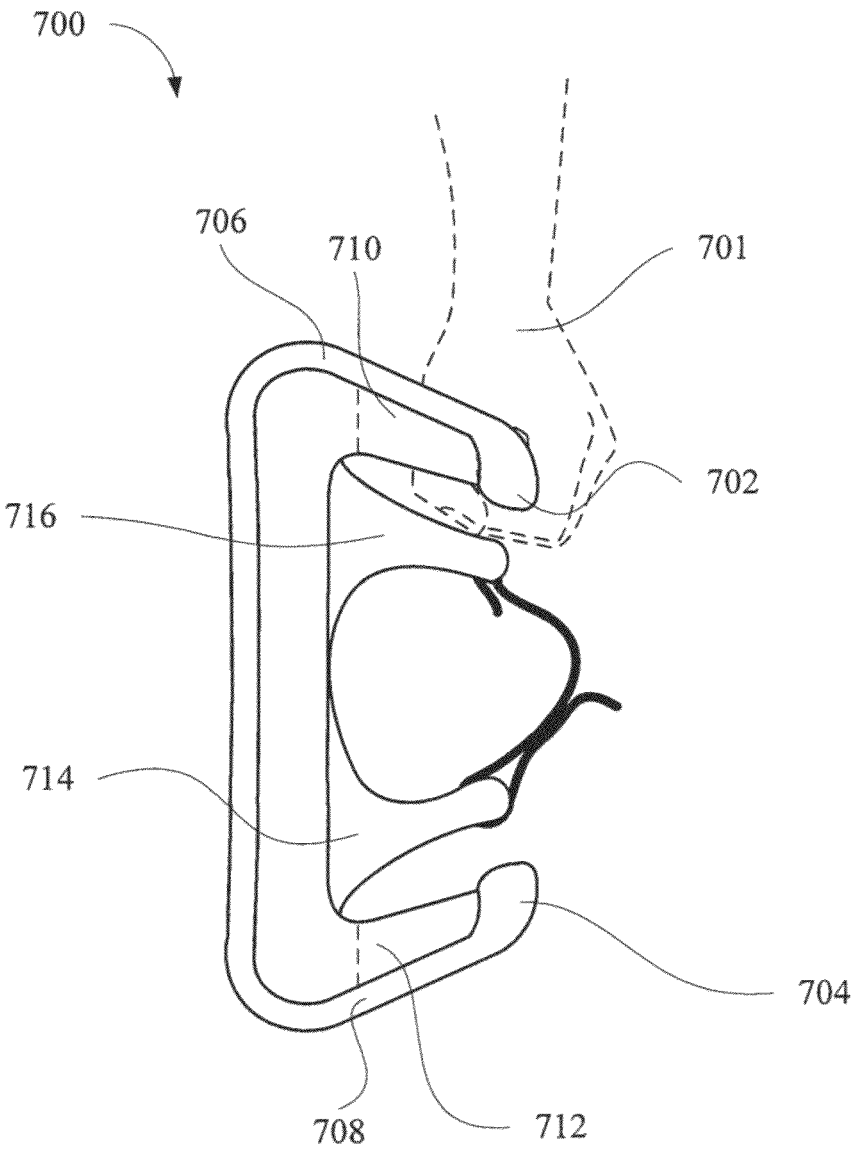
FIG. 7 is a side view of another fatigue reduction device being held by a user in accordance with an illustrative embodiment.

FIG. 7 is a side view of another fatigue reduction device 700 being held by a user 701 in accordance with an illustrative embodiment. The fatigue reduction device 700 is similar, in certain respects, to the fatigue reduction device 600 of FIG. 6. The fatigue reduction device 700 may include handles 702 and 704 at ends of the side faces 706 and 708. Spaces 710 and 712 may be defined within the side faces 706 and 708 allowing the user 701 to hold the fatigue reduction device 700 as is shown.

The fatigue reduction device 700 further includes extensions 714 and 716 that are curved and larger for better supporting the object when the user utilizes the handles 702 and 704. If only one side of the fatigue reduction device includes a handle, such as only handle 702, one extension 714 may be larger than the other extension 716 to lend support to the object when the fatigue reduction device is positioned vertically.

Figure 8:
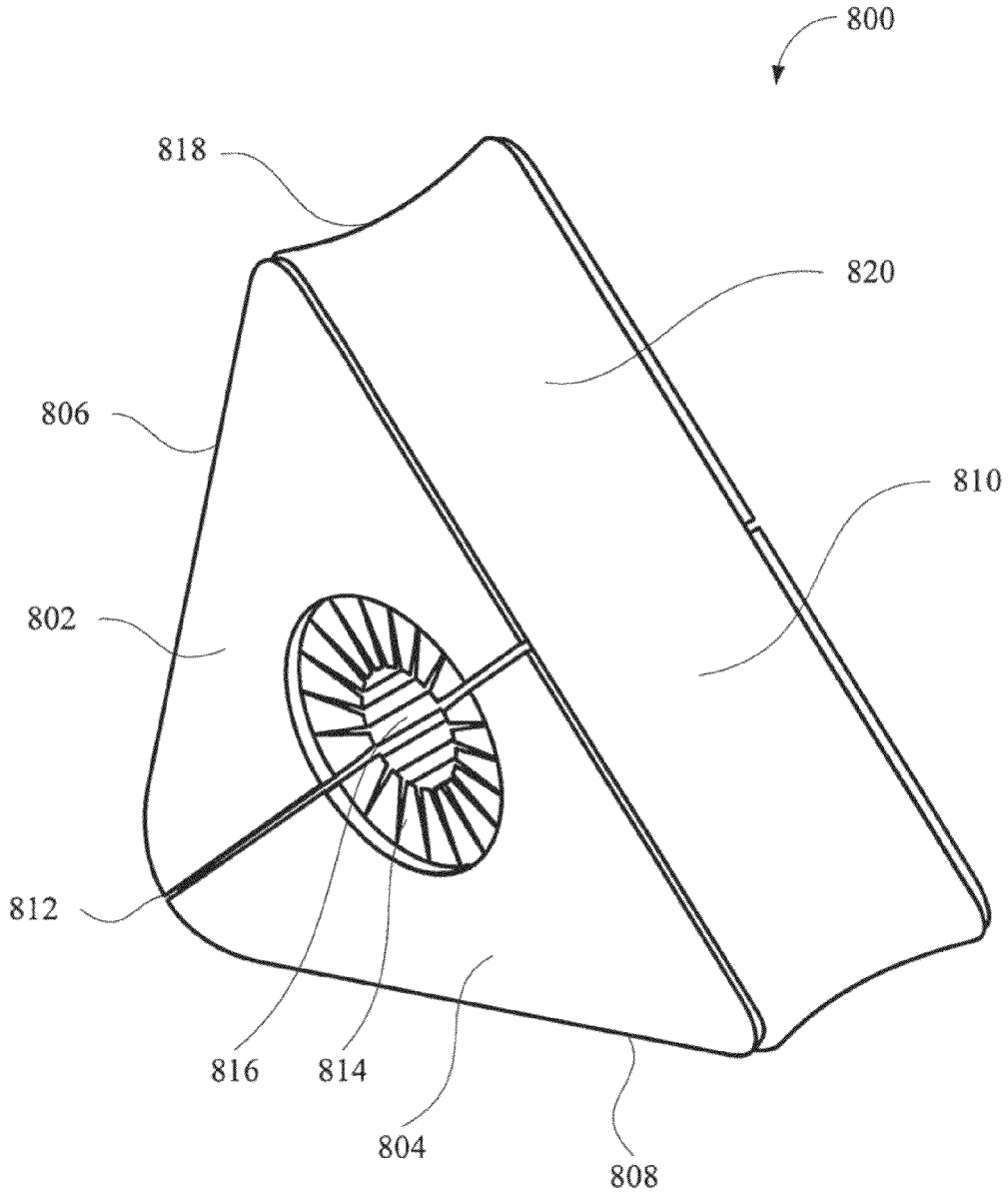
FIG. 8 is pictorial representation of another fatigue reduction device in accordance with an illustrative embodiment.
Figure 9:
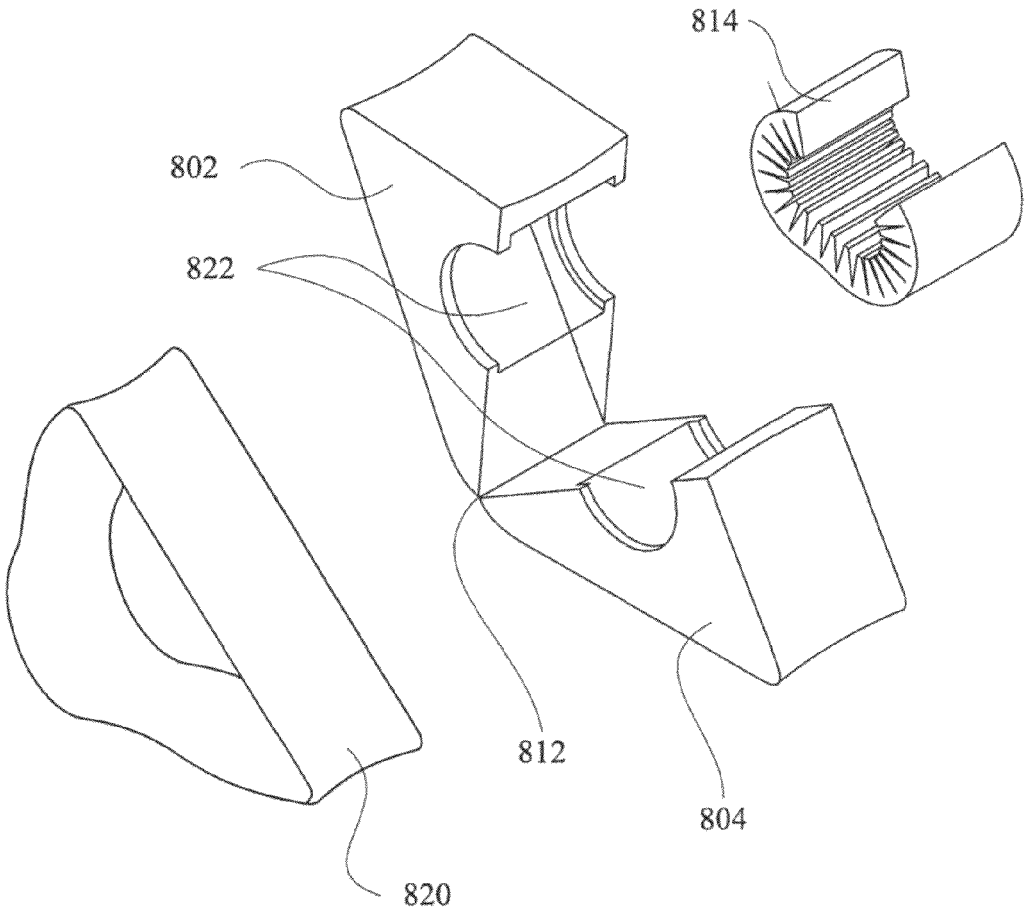
FIG. 9 is an exploded view of the fatigue reduction device of FIG. 8 in accordance with an illustrative embodiment.

Referring now to FIGS. 8-9, a pictorial representation of another fatigue reduction device 800 in accordance with an illustrative embodiment is shown. The fatigue reduction device 800 is triangularly shaped for use for more universal usage from different angles. In various embodiments, the fatigue reduction device 800 may have an equilateral or isosceles shape and configuration. An isosceles shape may be more useful for maximizing the surface area of the fatigue reduction device 800 against the forearm of the user.

In one embodiment, the fatigue reduction device 800 may include a first half 802, a second half 804, a first user-contactable face 806, a second user-contactable face 808, and a user-contactable third face 810, a hinge 812, a support 814, a cavity 816, a curved surface 818, and a cover 820. The first half 802 and second half 804 of the fatigue reduction device 800 may make up the frame. The first half 802 and second half 804 may be configured to open and close together around an object. The support 814 may be utilized to abut, support, secure, and/or stabilize the object. The support 814 at least partially defines the cavity 816 through which the object may pass. The cavity 816 is an opening or receptacle for receiving the object shown in this embodiment as a through hole.

In one embodiment, the support 814 may include protrusions, ridges, protuberances, or other components for securing the object. For example, the support 814 may be formed of rubberized ridges that provide a surface that enhances friction and prevents the free movement of the object when being carried by the fatigue reduction device 800. The support 814 may be utilized to ensure that the fatigue reduction device 800 does not slip or slide easily during utilization. For example, this may be particularly important when the fatigue reduction device 800 is being utilized with an infant carrier loaded with a child. In one embodiment, the support 814 may be integrated with the first half 802 and the second half 804. In another embodiment, the support 814 may be separately attached to the object with the first half 802 and the second half 804 enclosing the support 814. An outer surface of the support 814 in contact with the first half 802 and the second half 804 may be spherically shaped for securing the support 814. In a further embodiment, the triangularly shaped fatigue reduction device 800 may be formed of a flexible plastic or rubber membrane, wherein the entire device may be inflatable. This particular embodiment would not comprise hinge 812, first half 802, or second half 804. Instead, the outside frame of the fatigue reduction device 800 is continuous and formed of flexible plastic or rubber, while the inside of the device may be a hollow airtight chamber for holding air. A user may insert and/or remove air from the fatigue reduction device 800 by a nozzle included on the frame of the fatigue reduction device 800. A person of ordinary skill in the art would recognize that such a nozzle may be similar to those typically used in personal inflatable devices. After inflation by the user, the entire fatigue reduction device 800 may be one solid triangular shaped support system. In place of the hinge 812, a notch is formed for accessing the cavity 816 and inserting a carrier into the cavity 816 during use. Notably, the inflatable fatigue reduction device 800 would be lightweight during use, and easily stored and transported when not in use after deflation (e.g., in a purse or pocket).

The hinge 812 may represent a pivot point of the first half 802 and the second half 804. In one embodiment, the hinge 812 may represent a small flexible material or fabric connection between the first half 802 and the second half 804. The hinge 812 may be a barrel hinge, pivot hinge, continuous hinge, concealed hinge (self-biased), strap hinge, or other known hinge type. In another embodiment, the hinge 812 may represent a pin hinge about which the first half 802 and the second half 804 may pivot or rotate. The first face 806, the second face 808, and the third face 810 may similarly include the curved surface 818 to ergonomically fit or conform to the arm of the user during utilization.

The cover 820 may cover all or a portion of the fatigue reduction device 800. In one embodiment, the cover 820 is a padded band that conforms to the first face 806, the second face 808, and the third face 810. For example, the cover 820 may be a decorated neoprene band secured around the periphery of the fatigue reduction device 800. The cover 820 may also be utilized to further secure the first half 802 and the second half 804 together. The cover 820 may cover the exterior surfaces of the first face 806, second face 808, and third face 810 as well as side portions of the first half 802 and second half 804.

In one embodiment, the first half 802 and the second half 804 may include a buckle, elastic, latch, tie off, or other mechanism (not shown) for securing the first half 802 and the second half 804 around the object. As shown, the first half 802 and the second half 804 may define cutouts 822 for receiving the support 814.

In one embodiment, the cover 820 may be configured to cover the entire fatigue reduction device 800. The cover 820 may include a zipper, button, or other fasteners for being secured to or around the fatigue reduction device 800. The cover 820 may also be specifically sized to fit the fatigue reduction device 800. The cover 820 may provide a functional and decorative function. The cover 820 may include a pattern or decorations that are user selected and that may match or correspond to an object being carried or an intended usage of the cover 820. In one embodiment, the cover 820 is padded.

Figure 10:
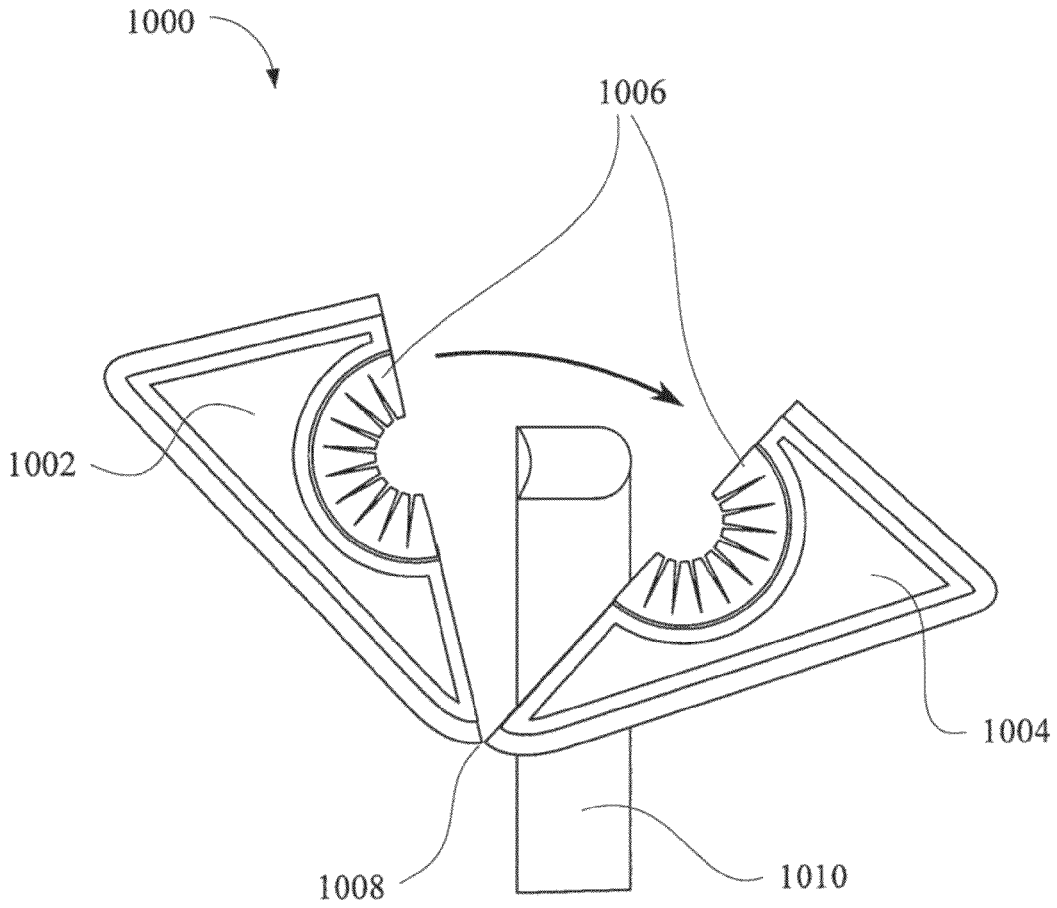
FIG. 10 is a side view of another fatigue reduction device in accordance with an illustrative embodiment.

FIG. 10 is a side view of another fatigue reduction device 1000 in accordance with an illustrative embodiment. The fatigue reduction device 1000 may include a first half 1002 and a second half 1004. The fatigue reduction device 1000 may include a support 1006 that is integrated with the first half 1002 and the second half 1004. The first half 1002 and the second half 1004 pivot about a hinge 1008 to enclose a handle 1010. The first half 1002 and second half 1004 may then be connected by a latching mechanism or secured together by a cover.

Figure 11:
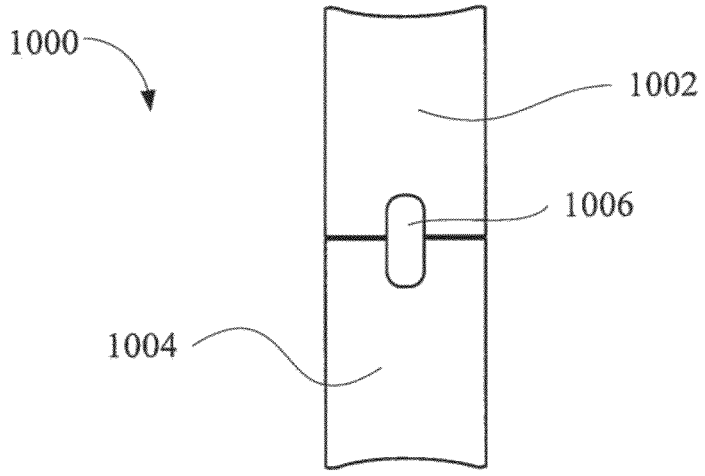
FIG. 11 is a rear view of a fatigue reduction device in accordance with an illustrative embodiment.

FIG. 11 is a rear view of the fatigue reduction device 1000 of FIG. 10 in accordance with an illustrative embodiment. In one embodiment, the first half 1002 and the second half 1004 may be connected utilizing a buckle 1006. In one embodiment, the first half 1002 and second half 1004 may be connected or attached for safety while being utilized. The first half 1002 and second half 1004 may also be connected by a band, string, lock, latch (e.g. spring latch, slam latch, cam lock, crossbar, hook, bolt latch, compression latch) or other similar component. For example, the first half 1002 and second half 1004 may include separate portions of a latch or buckle 1006.

Figure 12:
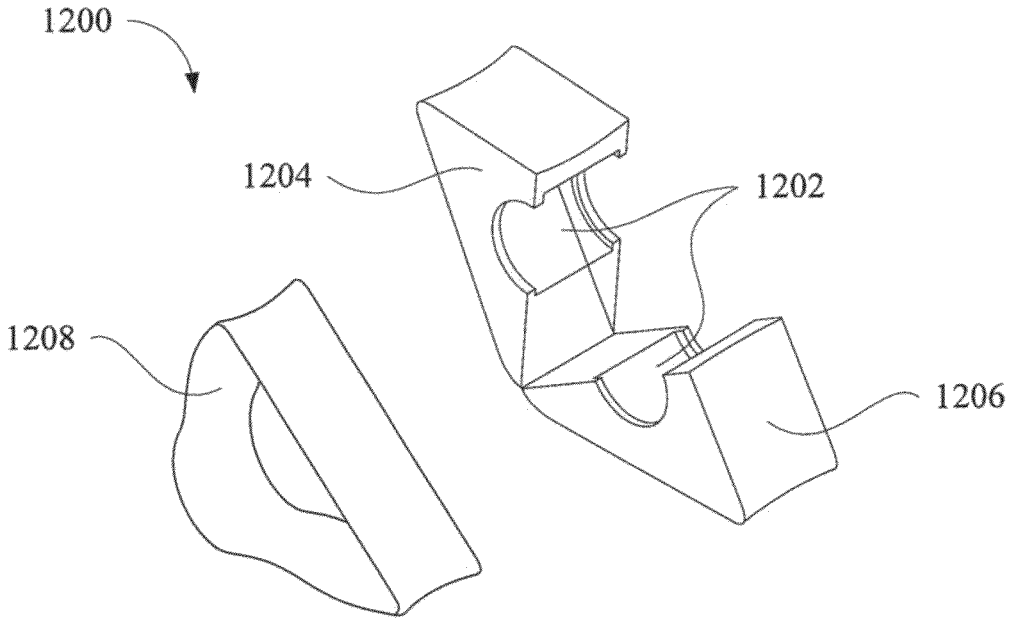
FIG. 12 is an exploded view of another fatigue reduction device in accordance with an illustrative embodiment.
Figure 13:
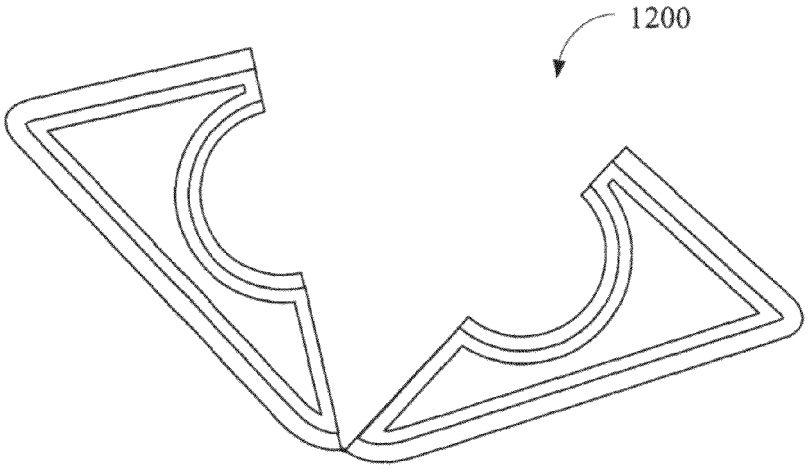
FIGS. 13-14 are pictorial representations of other fatigue reduction devices in accordance with illustrative embodiments.

FIG. 12 is a pictorial representation of another fatigue reduction device 1200 in accordance with an illustrative embodiment. The fatigue reduction device 1200 may not include an internal support as utilized in the previous embodiments. Instead cut-outs 1202 of a first half 1204 and a second half 1206 may support the object. A cover 1208 may also be secured around the fatigue reduction device 1200. FIG. 13 is a side view of the fatigue reduction device 1200 of FIG. 12 in accordance with an illustrative embodiment. The fatigue reduction device 1200 may include layers corresponding to layers or molding steps utilized during manufacturing.

Figure 14:
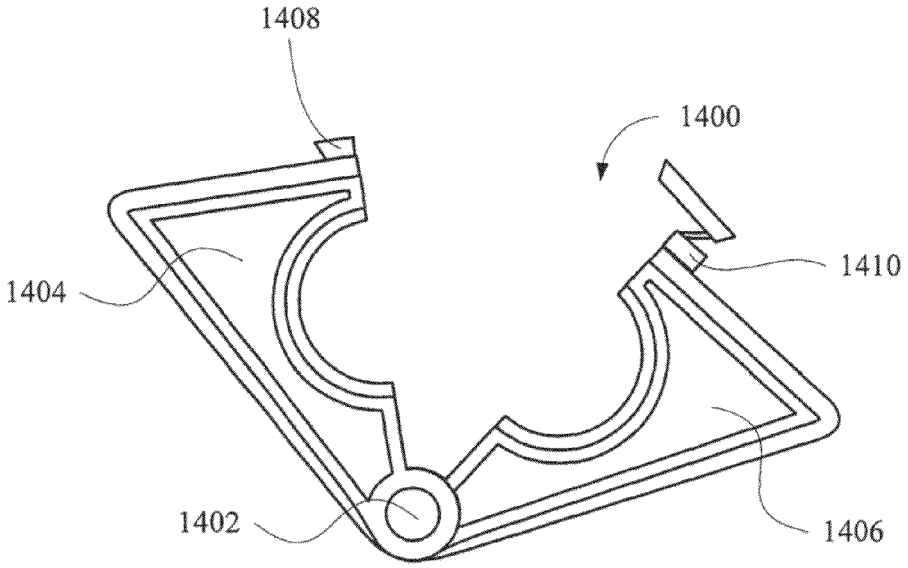

FIG. 14 is a side view of another fatigue reduction device 1400 in accordance with an illustrative embodiment. The fatigue reduction device 1400 further illustrates a hinge 1402 separating a first half 1404 and a second half 1406. The hinge 1402 may be formed of plastic or metal parts as are known in the art.

In one embodiment, the fatigue reduction device 1400 may include a connector, such as a buckle 1408, for connecting the first half 1404 and second half 1406 together. The buckle 1408 may extend externally from the fatigue reduction device 1400. In another embodiment, the buckle 1408 may be positioned within a recess of the ends of the first half 1404 and second half 1406 (not shown) so that it does not catch on the user, clothing, or anything else during utilization. The recess may include a relief point for allowing the user to attach and undo the buckle 1408.

Figure 15:
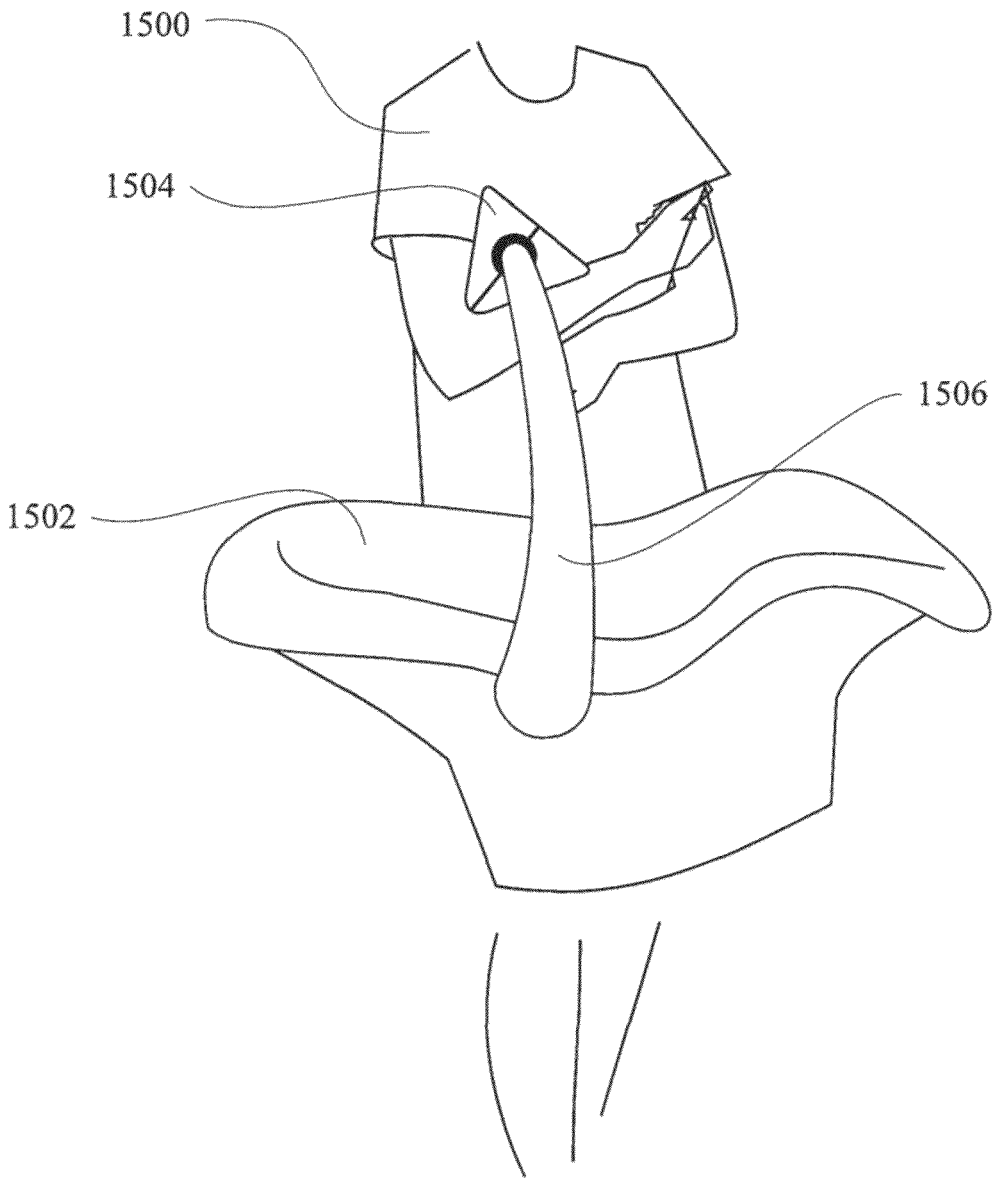
FIG. 15 is a pictorial representation of a user carrying an infant carrier utilizing a fatigue reduction device in accordance with an illustrative embodiment.

FIG. 15 is a pictorial representation of a user 1500 carrying an infant carrier 1502 utilizing a fatigue reduction device 1504 in accordance with an illustrative embodiment. The fatigue reduction device 1504 is connected to a handle 1506 of the infant carrier 1502.

The fatigue reduction device is shown as being utilized on an arm, but may be similarly utilized on a shoulder or other portion of a human or animal body or other physical components, such as a rail.

Figure 16:
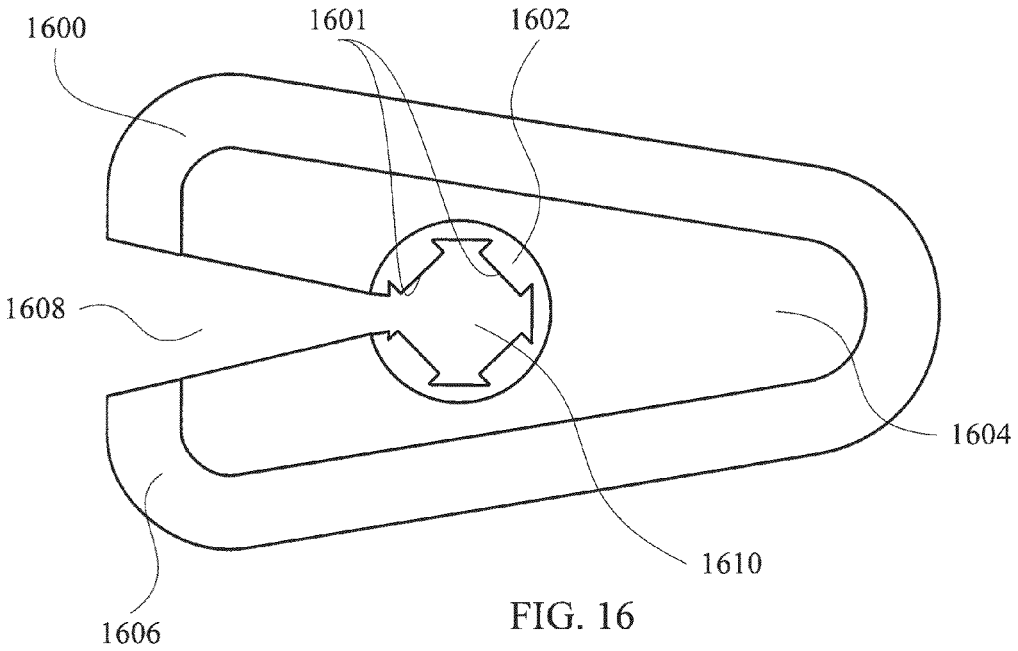
FIG. 16 is a side view of a another fatigue reduction device in accordance with an illustrative embodiment.

FIG. 16 is a side view of another fatigue reduction device 1600 in accordance with an illustrative embodiment. The fatigue reduction device 1600 may define a differently shaped support 1602 for supporting the object. For example, the support 1602 may include extensions 1601 as are shown. The support 1602 may secure the object during utilization while still allowing the fatigue reduction device 1600 to be easily rotated or positioned when not being utilized.

The fatigue reduction device 1600 includes a single frame 1604. The frame 1604 is co-molded with an exterior surface 1606. The exterior surface 1606 may be curved to conform to the arm of the user. The frame 1604 may further define an insertion cavity 1608. The insertion cavity 1608 is configured to receive an object into the cavity 1610 for utilization with the fatigue reduction device 1600. In one embodiment, the insertion cavity 1608 may include a funnel shape. The funnel shape allows the object to be more easily inserted and retained during utilization. The insertion cavity 1608 may also utilize other configurations or shapes, such as a slit or slot.

Figure 17:
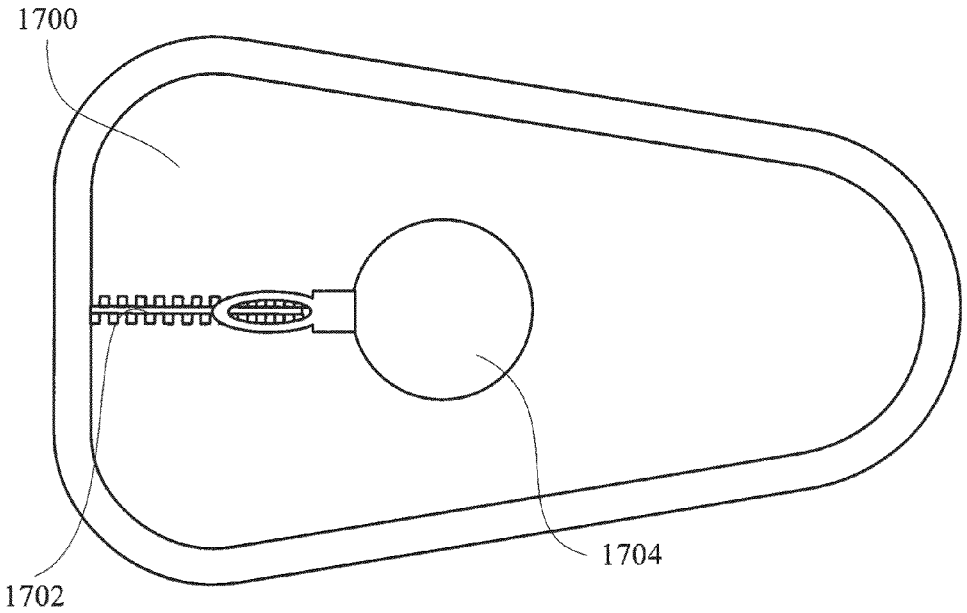
FIG. 17 is a pictorial representation of a cover for a fatigue reduction device in accordance with an illustrative embodiment.

FIG. 17 is a pictorial representation of a cover 1700 for a fatigue reduction device in accordance with an illustrative embodiment. The cover 1700 may be configured to substantially enclose the fatigue reduction device, such as the fatigue reduction device 1600 of FIG. 16. The cover 1700 may include a zipper 1702 for securing the cover 1700 to the fatigue reduction device. The zipper 1702 may be opened to access the fatigue reduction device. In one example, the zipper may extend between a through hole 1704 corresponding to the secured object or handle.

In another embodiment, the cover 1700 may utilize an overlapping flap, buttons, Velcro, or other fastening components to secure the cover 1700 to the fatigue reduction device. The cover 1700 may be formed of neoprene, cotton, flax, wool, Lycra, acrylics, olefin fiber, polylactide fibers, or other similar materials. In one embodiment, a synthetic fiber configured to stretch to fit the fatigue reduction device may be desirable. The cover 1700 may be configured to provide padding and absorb sweat from the user's arm. The cover 1700 may be easily removed and washed or replaced based on the preferences of the user. A cover may similarly be utilized with any of the embodiments herein described in the Figures although not specifically shown.

Figure 18:
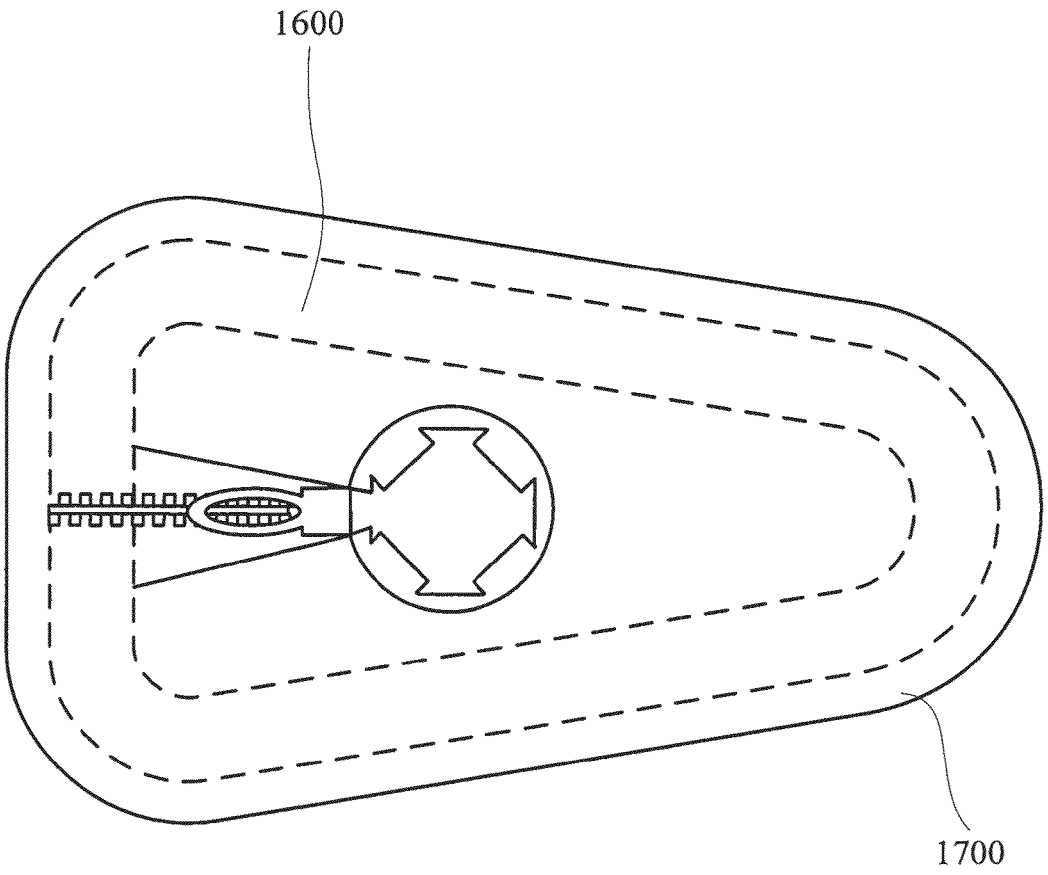
FIG. 18 is a pictorial representation of a fatigue reduction device with a cover in accordance with an illustrative embodiment.

FIG. 18 is a pictorial representation of the fatigue reduction device 1600 of FIG. 16 with the cover 1700 of FIG. 17 positioned or installed in accordance with an illustrative embodiment.

Figure 19:
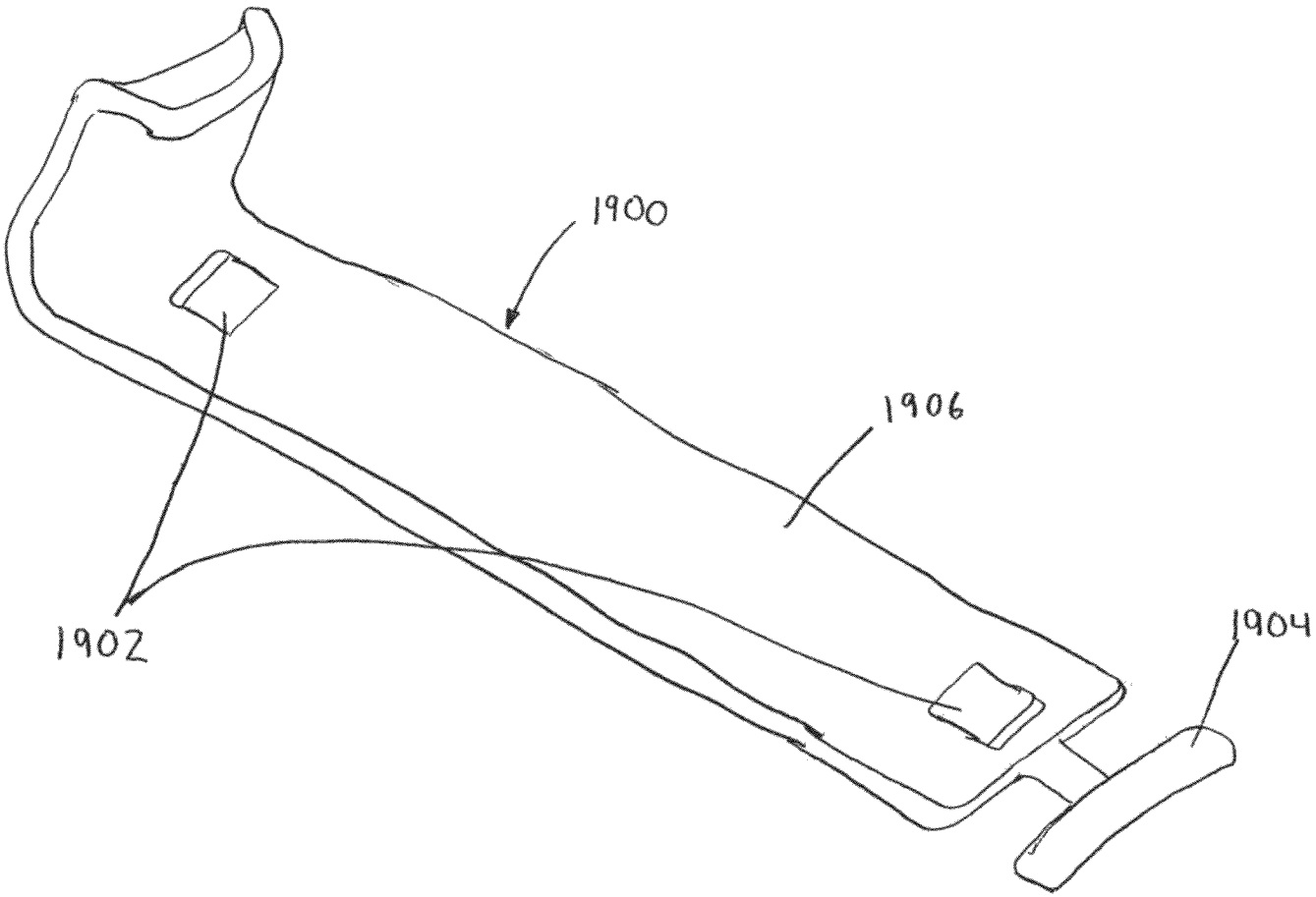
FIG. 19 is a pictorial representation of a fatigue reduction device in accordance with an illustrative embodiment.

FIG. 19 is a pictorial representation of a fatigue reduction device 1900 in accordance with an illustrative embodiment. The fatigue reduction device 1900 may include many of the attributes of FIG. 2. The fatigue reduction device 1900 may include clips 1902 and a handle 1904. In one embodiment, the clips 1902 are mechanically biased clips as are known in the art. The clips 1902 may include non-slip ends for ensuring that the attached device does not slip or is not marred during utilization. The clips 1902 may be configured to secure another component, such as a serving tray, holder or other component. As a result, a frame 1906 of the frame is elongated from the previously shown embodiments. The fatigue reduction device 1900 may also include Velcro, straps, bindings, or other mechanical attachment components in place of or in addition to the clips 1902.

The fatigue reduction device 1900 may include the handle 1904 for additional ease of use. In one embodiment, the handle 1904 is T-shaped. The handle 1904 may easily fit the hand size and shape of various users. The handle 1904 may be ergonomically shaped and may include any number of defining attributes, such as ridges, indentations, rounded shapes, or so forth to increase the ergonomics. The handle 1904 may also include the curvature of the frame 1906.

ALTERNATIVE EMBODIMENTS

In an alternative embodiment (not shown), the fatigue reduction device may not include the second portion 110 as shown in FIG. 1. Instead, the fatigue reduction device may be substantially planar (flat) for use on the forearm of the user. The fatigue reduction device may also include a handle and defined cavity for the hand of the user at one or more ends. The fatigue reduction device may also be configured to be folded up (e.g. manually, or automatically as biased by one or more spring elements, etc.) when stored or not in use. In another embodiment, the fatigue reduction device may be oval shaped and enclose the handle for utilization by the user. In a further embodiment, the fatigue reduction device may be a sleeve that fits around the arm, and particularly the elbow, of a user. The sleeve may be formed of lightweight, soft, flexible, breathable, and stretchable material. The sleeve may further comprise padding inside the elbow (e.g., the crook of the arm) and/or along a supinated side of a forearm of the user to support and distribute the weight of an object being carried across portions of the user's arm. The padding has a surface adapted to contact the user's arm, the surface having an area greater than the portion of the object rested on the user's arm. This padding may comprise high-strength flexible and/or semi-rigid plastics with co-molded, integrated, or additional padding, such as foam, rubber, or neoprene. This specific embodiment would be inconspicuous as it would allow a user to wear the fatigue reduction device under clothing. Furthermore, the device would not necessarily have to be removed when not in use, as the device would be lightweight, flexible and allow normal movement/range of motion of the arm.

METHOD OF USE: The fatigue reduction device may be utilized in any number of methods. In one embodiment, the process may begin by attaching the fatigue reduction device to an object to be carried. In one embodiment, the object is a strap or handle with the load being carried below the fatigue reduction device. In another embodiment, the object is a tray or plate with the load being carried on or above the fatigue reduction device. The fatigue reduction device may be actively or passively connected to the object. In one embodiment, the fatigue reduction device may be secured utilizing a Velcro strap that encloses the object between the frame of the fatigue reduction device and the Velcro strap. In another embodiment, the object may be secured to the fatigue reduction device utilizing a latching mechanism, such as a swinging arm and a buckle. The fatigue reduction device may also secure the object utilizing flexible or semi-rigid extensions that apply forces to the object.

In another embodiment, the fatigue reduction device may be an integrated portion of the object. For example, an infant carrier may include one or more fatigue reduction devices positioned along a handle. In one embodiment, the fatigue reduction device may be configured to be unfolded or expanded to form the shapes and configurations herein shown. For example, the fatigue reduction device may include cut-outs for the extensions and hinges at the corners that allow the fatigue reduction device to be folded in on itself. The fatigue reduction device may be slidably attached to the object allowing it to be positioned for use and then positioned for storage (out of the way) when not in use. For example, the fatigue reduction device may be slid into a receptacle, retracted, or collapsed when not in use.

The object may be tightly or loosely secured depending on the application and the user preferences. For example, some movement may be desirable to allow the fatigue reduction device to be positioned against the arm of the user wall securing the object at a desired angle. In another embodiment, the fatigue reduction device may be specifically configured to receive the object, such as a particular brand and model of infant carrier, laptop bag, book bag, purse, or a particular type of duffle bag.

In another embodiment, the object may be positioned on or rest on the fatigue reduction device. For example, the object may be simply positioned over the fatigue reduction device and held in place by gravity when utilized by the user.

Next, the fatigue reduction device is positioned on a user. In one embodiment, the fatigue reduction device is positioned on or against the arm of the user. The fatigue reduction device may be rested on the arm of the user. In one embodiment, the fatigue reduction device is positioned on the forearm of the user against the crook of the user's arm. In another embodiment, the fatigue reduction device may be positioned against another appendage or body part. In one embodiment, the fatigue reduction device may include one or more straps for securing the fatigue reduction device to the arm of the user. The fatigue reduction device may be long enough that the user may both position the fatigue reduction device in the crook of the user's arm and hold onto a handle of the fatigue reduction device utilizing the same arm.

METHOD OF MANUFACTURE

In one embodiment, the fatigue reduction device may be molded (injection molding, compression molding, and so forth as are known in the art). For example, the raw materials, such as plastic or polymer pellets may be heated and injected into a mold or die. The mold is configured to have any of the shapes and configurations (or a combination thereof) as are herein shown or described. Next, the fatigue reduction device is removed from the mold once substantially cooled. The fatigue reduction device may be sanded or otherwise smoothed to remove any seams or imperfections.

In another embodiment, the fatigue reduction device may be generated by utilizing a three dimensional printing process. A three-dimensional model of any of the described embodiments or any combination of the described embodiments may be implemented to print the fatigue reduction device. In one embodiment, the fatigue reduction device may be printed using a first rigid material and then a softer padded material may be printed on an exterior portion of the fatigue reduction device that comes in contact with the body of the user.

In one embodiment, the fatigue reduction device may be extended. For example, the frame 102 of FIG. 1 may be extended utilizing any of rails, latches and teeth, biased pins and holes, an overlapping frame or so forth. In addition, the angle of the corner portions may be rigid, flexible, or adjustable.

In one embodiment, the fatigue reduction device may extend along an entire length of the arm between the elbow and hand. The fatigue reduction device may be configured to receive any number of additional components. In one embodiment, the fatigue reduction device may not include extensions, such as extensions 112 and 114 (and including strap 116). Instead, the fatigue reduction device may be elongated including a handle and attachment mechanisms for receiving a tray, plate, or other component on the interior surface 117. The attachment mechanisms may include Clips, bindings, Velcro, or straps to secure the tray or other component. For example, the fatigue reduction device may be configured to receive a beverage serving tray as are utilized by airlines to serve drinks. As a result, the user may rest the fatigue reduction device on one arm securing the fatigue reduction device and attached tray between the bicep (second portion 110) and hand of the user (a handle 120 that is part of the elongated frame). The fatigue reduction device may provide for added stability, decreased hand fatigue, and easier access to the tray utilizing the user's other arm.

In one embodiment, the fatigue reduction device may include one or more hooks or extensions for securing other components. The fatigue reduction device may include hooks (e.g. J-hooks) or extensions on a left side and right side of the fatigue reduction device (when positioned on the user's arm) for holding bags (paper, plastic, reusable, recyclable, etc). As a result, the fatigue reduction device may be utilized when shopping at a mall, grocery store, outlet stores, or flea market to facilitate a user in carrying goods and providing different methods of carrying the goods (e.g. carried in the crook of the user's arm, utilizing a more defined handle provided by the fatigue reduction device). The fatigue reduction device may include any configuration of extensions, hooks, or structure of the fatigue reduction device to secure objects laterally or parallel to the longitudinal axis of the fatigue reduction device. For example, fatigue reduction device may allow shopping bags to be connected on a left and right side of a user's arm (when positioned on the user's forearm or in the crook of the user's arm).

In one embodiment, the fatigue reduction device may include a lanyard for attachment to any number of devices. For example, a lanyard may be utilized with a retracting cord connected to a base to secure the fatigue reduction device when not in use and so that it is not lost. The base may include a clip, suction cup, or clamp for attaching the fatigue reduction device to a purse, infant carrier, luggage, or other component.

In another embodiment, the angle of the handle of the fatigue reduction device may vary or be adjustable for adjusting the user's grip. Various angles and portions of the fatigue reduction device may be reconfigured, manipulated, or shaped to best fit the user. In addition, the fatigue reduction device may be carried in any number of positions.

In another embodiment, the fatigue reduction device may have a substantially tear drop shape (i.e. the side view of the profile). The end of the tear drop shape may be rounded. In one embodiment, the tear drop shape may include an integrated handle as is herein described.

The illustrative embodiments provide a fatigue reduction device that allows a user to carry an object, goods, carrier, or a load for longer periods of time without being worn out. In addition, arm and hand fatigue and soreness may be reduced. The fatigue reduction device may be particularly useful for users doing extended carrying (i.e. parks, airports, etc), users with limited strength, petite users, disabled users, and so forth. The fatigue reduction device may allow a user to have access to an ergonomic handle in situations where a handle may be beneficial, convenient, comfortable, or desirable. The fatigue reduction device provides multiple modes and methods for carrying objects that are adaptable to the needs of the user.

The previous detailed description is of a small number of embodiments for implementing the invention and is not intended to be limiting in scope. The following claims set forth a number of the embodiments of the invention disclosed with greater particularity.

What is claimed:

1. A fatigue reduction device, comprising:

a frame configured to receive a handle substantially perpendicularly to a longitudinal axis of the frame, wherein the frame comprises a longitudinal portion and an upstanding portion;

a corner separating the longitudinal portion from the upstanding portion of the frame, wherein the corner conforms to a crook of a user's arm;

a first extension on the longitudinal portion of the frame and a second extension on the upstanding portion of the frame, wherein the first and second extensions are configured to receive the handle; and a connector attached to the first extension and the second extension, wherein the connector is configured to secure the handle.

2. The fatigue reduction device according to claim 1, wherein the frame has a reverse seven shape.

3. The fatigue reduction device according to claim 1, wherein the longitudinal portion and the upstanding portion include at least one side for abutting the arm of the user.

4. The fatigue reduction device according to claim 1, wherein the first and second extensions have upper portions narrowing in width.

5. The fatigue reduction device according to claim 1, wherein the first and second extensions are separated by the corner.

6. The fatigue reduction device according to claim 5, wherein the connector comprises a hook and loop fastener connected between the first and second extensions for securing the handle to the longitudinal extending portion.

7. The fatigue reduction device according to claim 1, wherein the handle is any of a strap, fixed handle, or movable handle.

8. The fatigue reduction device according to claim 1, wherein the frame comprises a plastic.

9. The fatigue reduction device according to claim 8, wherein at least one side of the upstanding or longitudinal portions of the frame includes a padded surface.

10. The fatigue reduction device according to claim 1, wherein an end of the frame is curved to form a hook.

11. The fatigue reduction device according to claim 1, wherein an end of the frame defines a handle for the user to grip.

12. The fatigue reduction device according to claim 1, wherein at least one of the portions of the frame has an outer surface comprising a material with a material property to grip clothing worn by the user to keep the fatigue reduction device on the arm of the user during use.

13. The fatigue reduction device according to claim 1, wherein:

the frame comprises the longitudinal portion and at least two upstanding portions and at least two corners separating the longitudinal portion from the at least two upstanding portions of the frame;

the longitudinal portion and the at least two upstanding portions include at least three inwardly concave surfaces that abut an arm of a user.

14. The fatigue reduction device according to claim 1, wherein the frame is triangularly shaped.

15. The fatigue reduction device according to claim 1, wherein the frame comprises a hook and loop fastener.

16. The fatigue reduction device according to claim 1, wherein the frame comprises an inflatable membrane.

17. The fatigue reduction device according to claim 1, wherein:

the longitudinal portion is configured to fit against a forearm of a user and having an open configuration to receive either forearm of the user;

at least two upstanding portions are configured to fit against either bicep of the user and having an open configuration to receive a bicep of the user; and wherein the longitudinal portion and the upstanding portions are interchangeable against the forearms and the biceps of the user.

18. The fatigue reduction device according to claim 1, wherein the frame includes padding having a first surface to contact the user's arm and an opposite surface having a surface area greater than a portion of the object rested on the user's arm.

* * * * *